US012773079B2

(12) United States Patent
Millington et al.

(10) Patent No.: US 12,773,079 B2
(45) Date of Patent: Oct. 27, 2026

(54) ROBOTIC VACUUM CLEANING SYSTEM

(71) Applicant: Dyson Technology Limited, Wiltshire (GB)

(72) Inventors: David Alan Millington, Swindon (GB); David Stuart Cole, Bath (GB); David Christopher James Newton, Bristol (GB)

(73) Assignee: Dyson Technology Limited, Malmesbury (GB)

( * ) Notice: Subject to any disclaimer, the term of this patent is extended or adjusted under 35 U.S.C. 154(b) by 54 days.

(21) Appl. No.: 18/035,096

(22) PCT Filed: Oct. 20, 2021

(86) PCT No.: PCT/GB2021/052711

§ 371 (c)(1),
(2) Date: May 2, 2023

(87) PCT Pub. No.: WO2022/096850

PCT Pub. Date: May 12, 2022

(65) Prior Publication Data

US 2024/0000276 A1 Jan. 4, 2024

(30) Foreign Application Priority Data

Nov. 6, 2020 (GB) ..... 2017574

(51) Int. Cl.
*A47L 9/24* (2006.01)
*A47L 5/22* (2006.01)
(Continued)

(52) U.S. Cl.
CPC ..... *A47L 9/246* (2013.01); *A47L 5/225* (2013.01); *A47L 5/24* (2013.01); *A47L 9/009* (2013.01); *A47L 9/322* (2013.01); *A47L 2201/04* (2013.01)

(58) Field of Classification Search
CPC ..... H01R 13/005; H01R 13/06; A47L 9/246; A47L 9/2873; A47L 9/009
See application file for complete search history.

(56) References Cited

U.S. PATENT DOCUMENTS 4,634,197 A * 1/1987 Horlacher, Jr. ..... H01R 31/06 439/192
4,747,178 A * 5/1988 Breitbach ..... F24B 1/1915 15/246.2

(Continued)

FOREIGN PATENT DOCUMENTS

CN 101972128 A 2/2011
CN 103181743 A 7/2013

(Continued)

OTHER PUBLICATIONS

Examination Report received for GB Application No. 2017567.5, mailed on Feb. 13, 2023, 2 pages.

(Continued)

*Primary Examiner* — David S Posigian
*Assistant Examiner* — Dana Lee Poon
(74) *Attorney, Agent, or Firm* — Tucker Ellis LLP

(57) ABSTRACT

A vacuum cleaning system including a robotic unit including a traction arrangement that defines a ground plane, and a docking interface for receiving a handheld vacuum cleaner. The docking interface defines a suction port, an electrical port, and a predefined interface geometry. The docking interface is reconfigurable from a first configuration for engaging with a first handheld vacuum cleaner, and a second configuration for engaging with a second handheld vacuum cleaner which is different to the first handheld vacuum cleaner. Conveniently, the system includes a robotic unit or module that is dockable or engageable with multiple handheld vacuum cleaners, thus allowing some flexibility with the type of machine that they are able to use with the robotic (Continued)

unit. This provides a cost effective solution for the user, because if the user upgrades their handheld vacuum cleaner that new handheld vacuum cleaner can still be used with the robotic unit.

11 Claims, 8 Drawing Sheets

(51) Int. Cl.

| | |
|---|---|
| ***A47L 5/24*** | (2006.01) |
| ***A47L 9/00*** | (2006.01) |
| ***A47L 9/32*** | (2006.01) |

(56) References Cited

U.S. PATENT DOCUMENTS

| | | | | |
|---|---|---|---|---|
| 5,148,573 | A | 9/1992 | Killian et al. | |
| 5,497,529 | A | 3/1996 | Boesi | |
| 5,709,007 | A * | 1/1998 | Chiang | A47L 5/24 15/340.1 |
| 7,113,847 | B2 | 9/2006 | Chmura et al. | |
| 8,079,113 | B2 | 12/2011 | Chong et al. | |
| 9,173,531 | B2 | 11/2015 | Chiu et al. | |
| 10,638,898 | B2 | 5/2020 | Chiu et al. | |
| 11,324,373 | B2 | 5/2022 | Lee et al. | |
| 2007/0042624 | A1 | 2/2007 | Gerving et al. | |
| 2009/0133720 | A1 | 5/2009 | Van Den Bogert | |
| 2010/0256812 | A1* | 10/2010 | Tsusaka | B25J 5/007 700/254 |
| 2012/0189507 | A1* | 7/2012 | Ko | A47L 11/4036 261/78.2 |
| 2013/0269148 | A1* | 10/2013 | Chiu | A47L 9/009 15/329 |
| 2014/0289998 | A1 | 10/2014 | Wang | |
| 2018/0213986 | A1 | 8/2018 | Chiu et al. | |
| 2018/0317725 | A1 | 11/2018 | Lee et al. | |
| 2019/0183306 | A1 | 6/2019 | King et al. | |
| 2020/0001468 | A1 | 1/2020 | Song et al. | |
| 2020/0163507 | A1 | 5/2020 | Percy-Raine et al. | |
| 2020/0205371 | A1 | 7/2020 | Kuo et al. | |
| 2020/0298415 | A1 | 9/2020 | Sun et al. | |
| 2021/0219803 | A1 | 7/2021 | Lee et al. | |

FOREIGN PATENT DOCUMENTS

| | | | |
|---|---|---|---|
| CN | 203506595 | U | 4/2014 |
| CN | 205568870 | U | 9/2016 |
| CN | 106426198 | A | 2/2017 |
| CN | 106532375 | A | 3/2017 |
| CN | 206403702 | U * | 8/2017 |
| CN | 107137012 | A | 9/2017 |
| CN | 107334420 | A | 11/2017 |
| CN | 108403013 | A | 8/2018 |
| CN | 108542311 | A | 9/2018 |
| CN | 208864220 | U | 5/2019 |
| CN | 109984669 | A | 7/2019 |
| CN | 209377444 | U | 9/2019 |
| CN | 110367878 | A | 10/2019 |
| CN | 209574563 | U | 11/2019 |
| DE | 4214378 | C1 | 8/1993 |
| DE | 10000407 | A1 | 7/2001 |
| EP | 1987407 | A1 | 11/2008 |
| EP | 2649920 | A1 | 10/2013 |
| EP | 3357391 | A1 | 8/2018 |
| EP | 3446608 | A1 | 2/2019 |
| EP | 3476265 | A1 | 5/2019 |
| EP | 3476266 | A1 | 5/2019 |
| EP | 3666144 | A1 | 6/2020 |
| EP | 3666145 | A1 | 6/2020 |
| JP | 10-118963 | A | 5/1998 |
| JP | 2000139782 | A | 5/2000 |
| JP | 2006-043302 | A | 2/2006 |
| JP | 2007-282834 | A | 11/2007 |
| JP | 4295323 | B2 | 7/2009 |
| JP | 4512672 | B2 | 7/2010 |
| JP | 3187463 | U | 11/2013 |
| JP | 2014-144051 | A | 8/2014 |
| KR | 10-0283863 | B1 | 3/2001 |
| KR | 20030086035 | A | 11/2003 |
| KR | 10-2004-0084359 | A | 10/2004 |
| KR | 10-2006-0063426 | A | 6/2006 |
| KR | 10-0596479 | B1 | 7/2006 |
| KR | 10-2008-0028219 | A | 3/2008 |
| KR | 10-1015465 | B1 | 2/2011 |
| KR | 10-1208979 | B1 | 12/2012 |
| KR | 20170133620 | A | 12/2017 |
| KR | 10-2018-0025794 | A | 3/2018 |
| KR | 10-1878142 | B1 | 8/2018 |
| TW | M468289 | U | 12/2013 |
| WO | 93/22108 | A1 | 11/1993 |
| WO | 96/03259 | A1 | 2/1996 |
| WO | 2008/142642 | A1 | 11/2008 |
| WO | 2010/016210 | A1 | 2/2010 |
| WO | 2017/157302 | A1 | 9/2017 |
| WO | 2020095046 | A1 | 5/2020 |
| WO | 2020177181 | A1 | 9/2020 |
| WO | 2022/096846 | A1 | 5/2022 |
| WO | 2022/096847 | A1 | 5/2022 |
| WO | 2022/096849 | A1 | 5/2022 |

OTHER PUBLICATIONS

International Search Report and Written Opinion received for PCT Patent Application No. PCT/GB2021/052708, mailed on Jan. 26, 2022, 10 pages.

International Search Report and Written Opinion received for PCT Patent Application No. PCT/GB2021/052709, mailed on Jan. 19, 2022, 10 pages.

International Search Report and Written Opinion received for PCT Patent Application No. PCT/GB2021/052707, mailed on Jan. 28, 2022, 11 pages.

International Search Report and Written Opinion received for PCT Patent Application No. PCT/GB2021/052710, mailed on Feb. 8, 2022, 12 pages.

International Search Report and Written Opinion received for PCT Patent Application No. PCT/GB2021/052711, mailed on Jan. 26, 2022, 10 pages.

Search Report received for GB Application No. 2017567.5, mailed on Apr. 15, 2021, 2 pages.

Search Report received for GB Application No. 2017570.9, mailed on Apr. 12, 2021, 1 page.

Search Report received for GB Application No. 2017574.1, mailed on Apr. 12, 2021, 1 page.

* cited by examiner

ROBOTIC VACUUM CLEANING SYSTEM

RELATED APPLICATION DATA

This application is the National Stage of International Application No. PCT/GB2021/052711 filed Oct. 20, 2021, and claims benefit of United Kingdom Application No. 2017574.1 filed Nov. 6, 2020, each of which are herein incorporated by reference in their entirety.

TECHNICAL FIELD

The invention relates to a robotic vacuum cleaning system.

BACKGROUND

The robotic vacuum cleaner market has grown hugely over the past decade. Changes in lifestyle, increased disposable income, urbanisation and growing focus on labour-saving devices are some of the factors that have boosted market growth, and the trend seems to be set to continue.

Whilst the robotisation of vacuum cleaners has seen more products enter the market, the form factor of such robots has not tended to diversify. Generally, robotic vacuum cleaners available on the market are discoidal in shape, with a low height so they can travel underneath furniture in order to clean there. The main technological developments have focused on improving navigational capabilities to improve autonomy, bin emptying systems and run time. In the main, however, the robotic vacuum cleaner market includes many generally circular machines that offer very little in terms of differentiation.

Some effort has been made to improve the functionality of robot vacuum cleaners to cope with demanding environments. For example, US2020/001468 describes a robotic cylinder-style machine which has a cleaner head that can locomote separately. The cleaner head can therefore driver itself away from the main body of the machine to as to stretch underneath furniture.

US2018/317725 and US2010/0256812 describe discoidal robots which are equipped with robotic arms. However, neither of these examples appears to be a practical application, and the utility of the robotic arm in each case seems to be limited.

It is against this background that the embodiments of the invention have been devised.

SUMMARY OF THE INVENTION

According to a first aspect of the invention there is provided a vacuum cleaning system comprising a robotic unit comprising a traction arrangement that defines a ground plane, and a docking interface for receiving a handheld vacuum cleaner, wherein the docking interface defines a suction port, an electrical port, and a predefined interface geometry. The docking interface is reconfigurable from a first configuration for engaging with a first handheld vacuum cleaner, and a second configuration for engaging with a second handheld vacuum cleaner which is different to the first handheld vacuum cleaner.

Conveniently, therefore, the invention provides a robotic vacuum cleaning system with a robotic unit or module that is dockable or engageable with multiple handheld vacuum cleaners. The user therefore is allowed some flexibility with the type of machine that they are able to use with the robotic unit. This provides a particularly cost effective and technically elegant solution for the user, because if the user upgrades their handheld vacuum cleaner, for example to a model with an improved suction power or battery life, that new handheld vacuum cleaner can still be used with the robotic unit.

The docking interface may be re-configurable in various ways. For example, it is envisaged that in one example the docking interface may have various features that are movable or adaptable in some way so as to accept different types of handheld vacuum cleaners. For example one or more of the suction port, electrical port or geometry of the interface may be changed in some way to re-configure them from the first to the second configuration.

In an alternatively configuration, the docking interface may be provided at least in part by an interface adapter. Each of the first and second configurations of the docking interface may be provided by a respective interface adapter. Or, in another example, the first configuration may be provided by the structure of the main body of the robotic unit and the second configuration may be provided by an interface adapter that fits onto the docking interface. Therefore, if the user wanted to use a different type of vacuum cleaner with the robotic unit, they could simply purchase a suitable interface adapter for the particular type of machine.

Each of the interface adapters therefore will define a respective suction port and electrical port that are connectable to the suction port and electrical port of the robotic unit when the interface adapter is in position on the machine. The interface adapter will also define its own interface geometry specific to the handheld vacuum cleaner with which it is designed to be used.

The system may therefore include at least a first handheld vacuum cleaner and a second handheld vacuum cleaner each of which can be used with the robotic unit directly via the docking interface or indirectly via a respective interface adapter. Thus in one example, a first handheld vacuum cleaner is configured to releasably engage with the docking interface without the interface adapter attached, such that when the first handheld vacuum cleaner engages with the docking interface, the first handheld vacuum cleaner is operable to apply suction to the suction port of the robotic unit. In another example, a first handheld vacuum cleaner is configured to releasably engage with the docking interface via a respective interface adapter, such that when the first handheld vacuum cleaner engages with the docking interface, the first handheld vacuum cleaner is operable to apply suction to the suction port of the robotic unit via its respective interface adapter.

Similarly, a second handheld vacuum cleaner may be configured to engage with the docking interface via the at least one a respective interface adapter whereupon it connects to the suction port and the electrical port of the robotic unit via the respective suction port and the respective electrical port of the respective interface adapter.

Each of the handheld vacuum cleaners may be supported by the docking interface in a position and orientation such that the longitudinal axis of the second handheld vacuum cleaner is oriented generally vertically with respect to the ground plane. In such an arrangement, the handheld vacuum cleaners may include a pistol grip which is oriented generally parallel with respect to the ground plane. This provides an ergonomically advantageous way for the user to grasp the handheld vacuum cleaner for docking and undocking. When the handheld vacuum cleaner is mounted on the docking interface, the pistol grip may be generally aligned with a forward direction of the robotic unit as defined by the traction arrangement, and preferably may extend in the forward direction. The direction in which the pistol grip extends may coincide with the direction in which the articulated arm extends.

Conveniently, the robotic unit and the respective handheld vacuum cleaner may share one or more common suction tools, which means that both machines can be optimised for the surfaces they are intended to clean. The suction tools may be passive, that is without a motorised bush bar or agitator, such as may be the case for floor tools optimised for hard floors, or the suction tools may be motorised which makes them particularly suited to piled floor coverings such as carpets and rugs.

In one arrangement, the docking interface is provided on a first side of the robotic unit and wherein an articulated arm extends from the robotic unit from a position on a second side thereof. This configuration is beneficial in terms of distribution of mass around the robotic unit which improves manoeuvrability.

The docking interface of the robotic unit may be the only means of support for the handheld vacuum cleaner in the docked configuration. However, optionally, a support structure may extend from the main body of the robotic to support or engage the handheld vacuum cleaner at a location that is not where the vacuum cleaner is supported by the docking interface. For example, it may support or engage with the pistol grip style handle, or even a battery pack located on the pistol grip style handle. The supporting structure may be configured like a cradle for the handle and/or battery pack. In one example the handle/battery pack may releasably lock onto the supporting structure. In this case, the supporting structure may provide a useful additional lifting point so that the robotic unit may be suspended from the handheld vacuum cleaner in a carrying position. The robotic unit may therefore be connected to the handheld vacuum cleaner by the docking interface and also by the battery supporting structure. The supporting structure may also engage with the handle or pistol grip of the handheld vacuum cleaner.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

The above and other aspects of the invention will now be described, by way of example only, with reference to the accompanying drawings, in which:

FIG. 6*a* shows the handheld vacuum cleaner docked on the robotic drive module, and FIG. 6*b* shows the handheld vacuum cleaner separated from the robotic drive module;

Note that features that are the same or similar in different drawings are denoted by like reference signs.

Specific Description

A specific embodiment of the invention will now be described in which numerous features will be discussed in detail in order to provide a thorough understanding of the inventive concept as defined in the claims. However, it will be apparent to the skilled person that the invention may be put into effect without the specific details and that in some instances, well known methods, techniques and structures have not been described in detail in order not to obscure the invention unnecessarily.

In overview, the invention provides a novel type of robotically-driven surface treating system, which is embodied in the illustrated examples as a vacuum cleaning system. The cleaning system is a hybrid design which comprises a robotic drive unit or module, and a handheld vacuum cleaner that is removably attachable to the robotic drive module. Moreover, the robotic drive module is equipped with a robotic arm which carries a cleaning tool or head on its distal end. The robotic arm therefore provides the robotic cleaning system with an extended reach so that it can clean under low-lying furniture. A convenient feature of the system is that the cleaning tool which is attachable to the distal end of the robotic arm, can also be attached to the handheld vacuum cleaner, either directly or via a wand extension tube. The cleaning system is therefore particularly convenient because a user can use the handheld vacuum cleaner to carry out spot-cleaning or more wide-spread cleaning tasks, e.g. when it is in stick-vac mode, but then the cleaner head can be installed onto the robotic drive module so that it can carry out autonomous cleaning tasks on a schedule that suits the user. Further features and advantages will become apparent from the discussion that follows.

Figure 1:
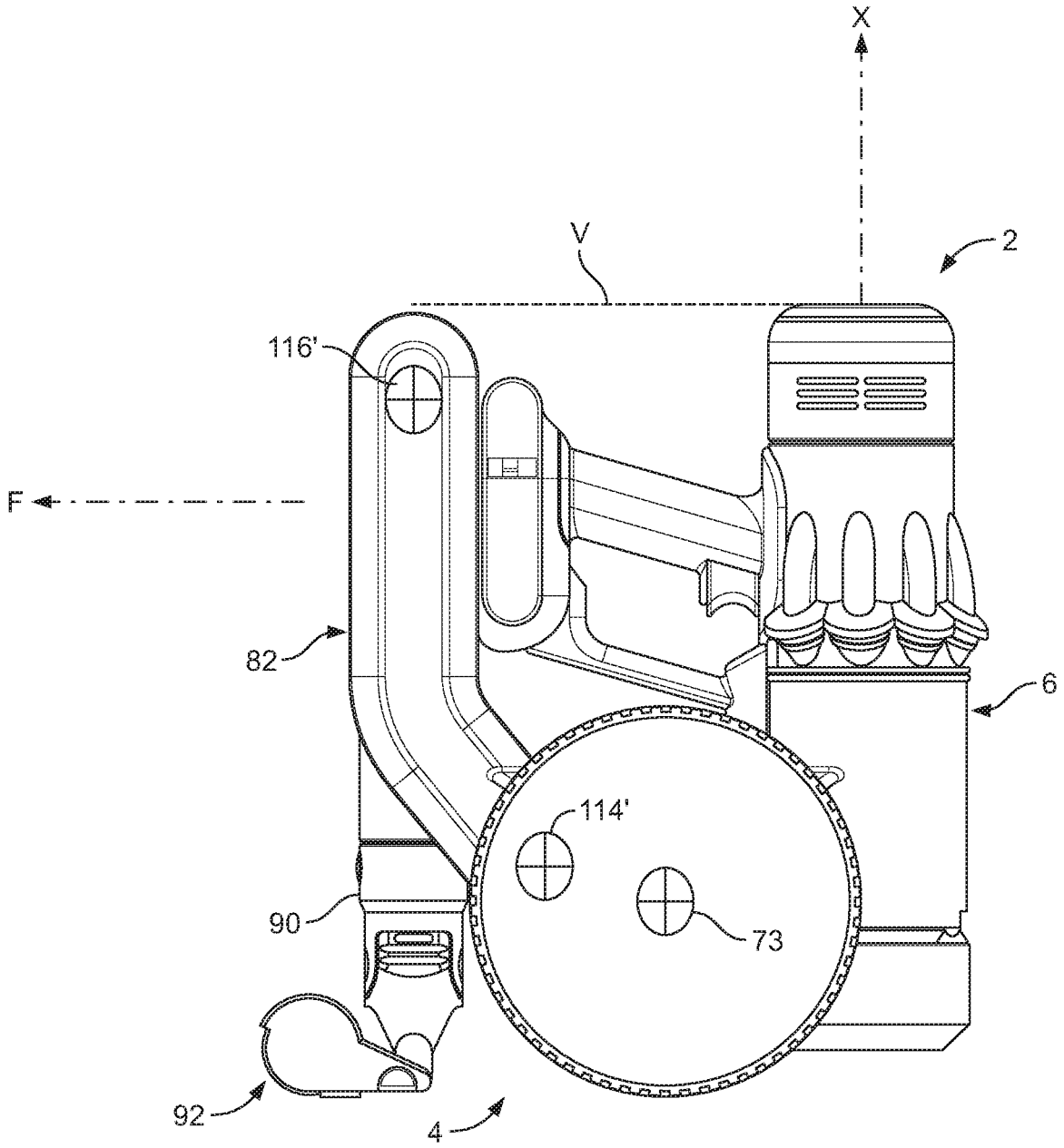
FIG. 1 is a is a side view of a vacuum cleaning system, in accordance with an example of the invention, comprising a robotic drive module having a robotic arm, and a handheld vacuum cleaner mounted on the robotic drive module.
Figure 2:
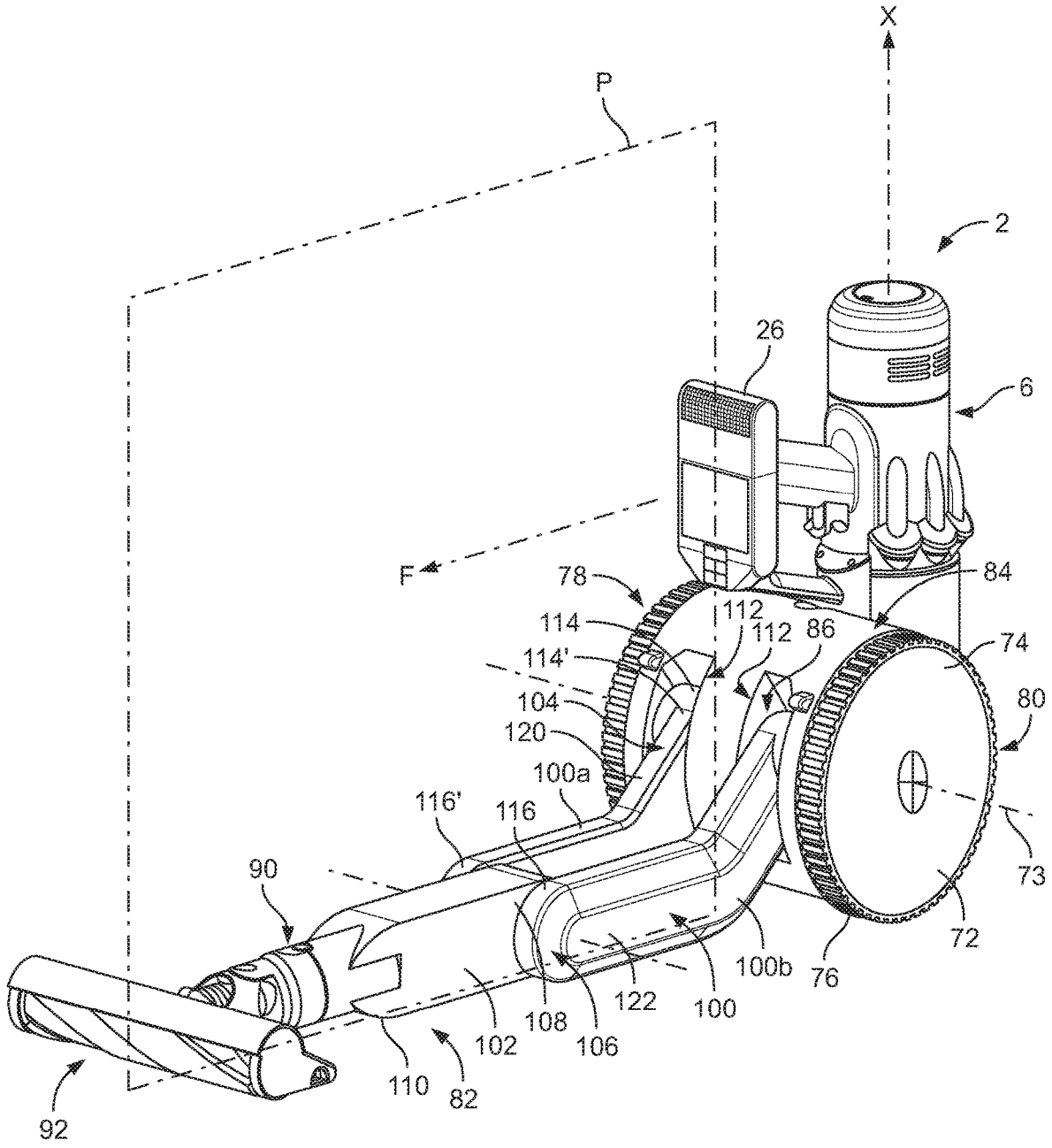
FIG. 2 is a perspective view of the vacuum cleaning system of FIG. 1, with the robotic arm in a fully deployed state.
Figure 3:
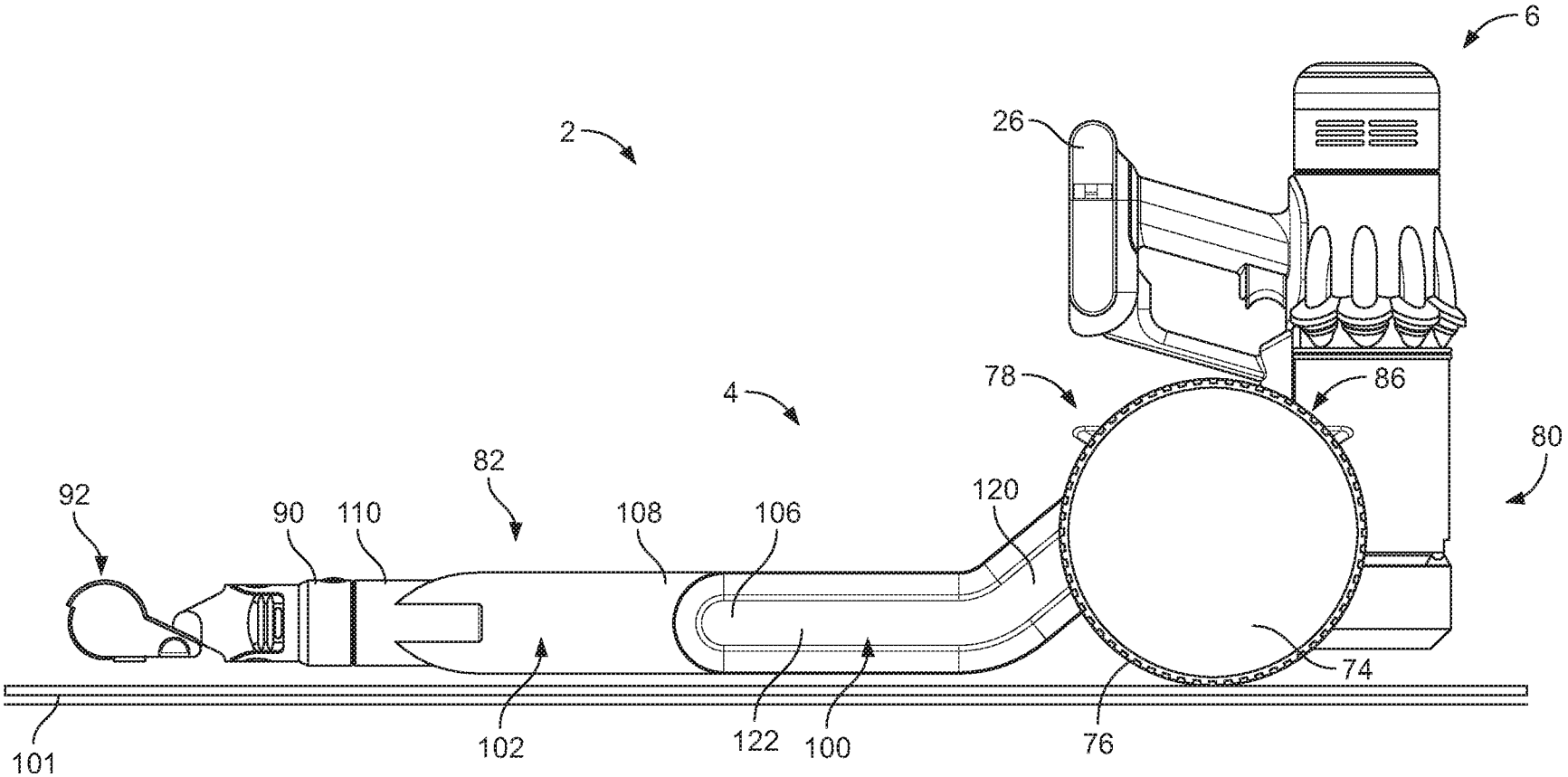
FIG. 3 is a side view of the vacuum cleaning system, with the arm in a deployed state like that in FIG. 2.
Figure 6B:
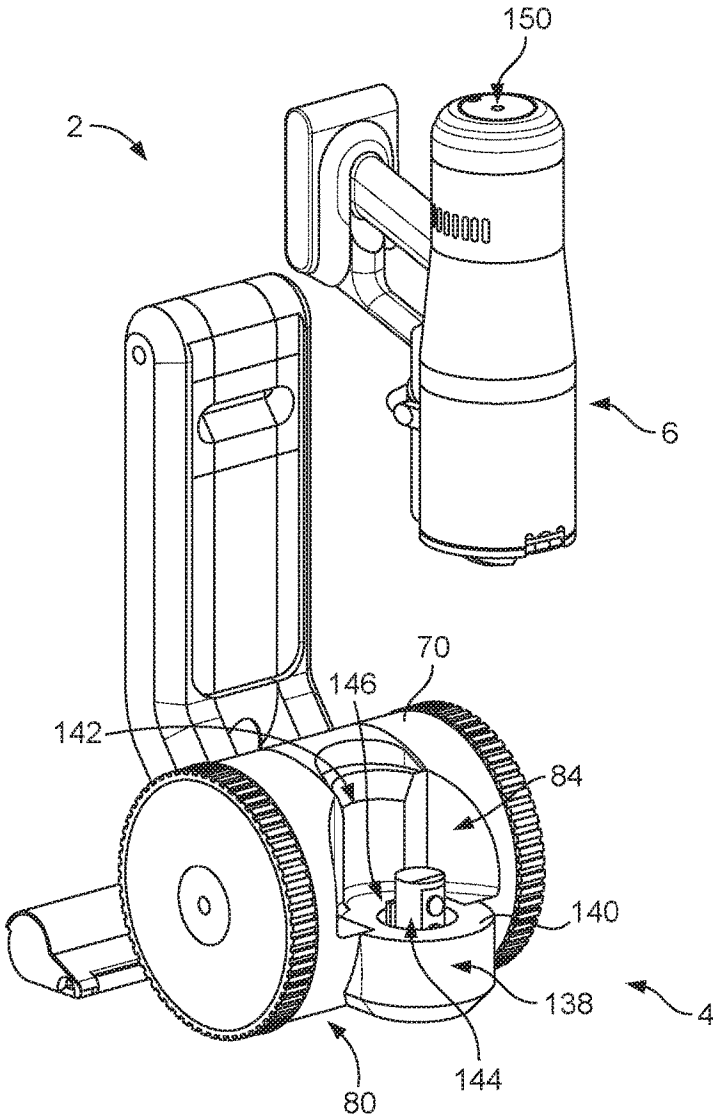
FIGS. 6*a* and 6*b* are perspective views of the vacuum cleaning system when viewed from the rear, where

The illustrated figures show a robotic vacuum cleaner 2 in accordance with an example of the invention. Referring firstly to FIGS. 1 to 3, the robotic vacuum cleaner 2 comprises two main parts. The first part is a robotic drive section, unit, or module and is labelled generally as '4' and the second part is a handheld vacuum cleaner, which is labelled generally as '6'. As will be appreciated, the handheld vacuum cleaner 6 is separable from the robotic drive module 4 such that the handheld vacuum cleaner 6 can be used on its own as a vacuum cleaning machine when it is undocked from the robotic drive module 4, or it may function together with the robotic drive module 4 to provide an autonomous vacuum cleaner system 6. As can be seen, FIGS. 1 to 3 show the robotic drive module 4 and the handheld vacuum cleaner 6 in a docked state, whilst FIG. 6*b* shows the robotic drive module 4 and in a separated or undocked state.

In this example, the machine is a vacuum cleaner, but it is also envisaged that various adaptations may be made so that it performs other surface treating functions such as mopping, polishing, sanitiser-spraying and so on. So, the cleaning system in accordance with the invention should also be considered to extend to surface treating appliances or systems. For present purposes, however, the discussion will refer to a vacuum cleaner, but it should be appreciated that the embodiments of the invention may have broader application to general surface treating functionality.

Returning to FIGS. 1 to 3, it will be appreciated that the robotic drive module 4 and handheld vacuum cleaner 6 are dockable so as to function as a self-propelled robotic vacuum cleaner. In this respect, the robotic drive module 4 provides the locomotion requirements of the machine, whilst the handheld vacuum cleaner 6 provides the suction power.

It is envisaged that each sub-unit may provide its own power, such that the robotic drive module 4 will include an on-board battery pack (not shown) to provide power to its respective drive motors (not shown), whilst the handheld vacuum cleaner 6 includes a battery pack to provide power to its on-board vacuum motor. However, it is also envisaged that power transfer between the robotic drive module 4 and the handheld vacuum cleaner 6 would be beneficial, during charging for example. Usefully, therefore, the handheld vacuum cleaner 6 can be used on its own, either in the form of a handheld vacuum cleaner or in the form of a stick-vac machine if the user wants to perform their own cleaning, for example to spot-remove debris from certain areas in the house. However, the handheld vacuum cleaner 6 can be docked onto the robotic drive module 4 such that the two machines then function as an autonomous vacuum cleaner.

At this point it should be appreciated that the robotic drive module 4 would also be provided with a suitable navigation system which would be responsible for mapping, path planning and task scheduling operations. However, this functionality is beyond the scope of this discussion and so further explanation of these aspects will be omitted.

Figure 4:
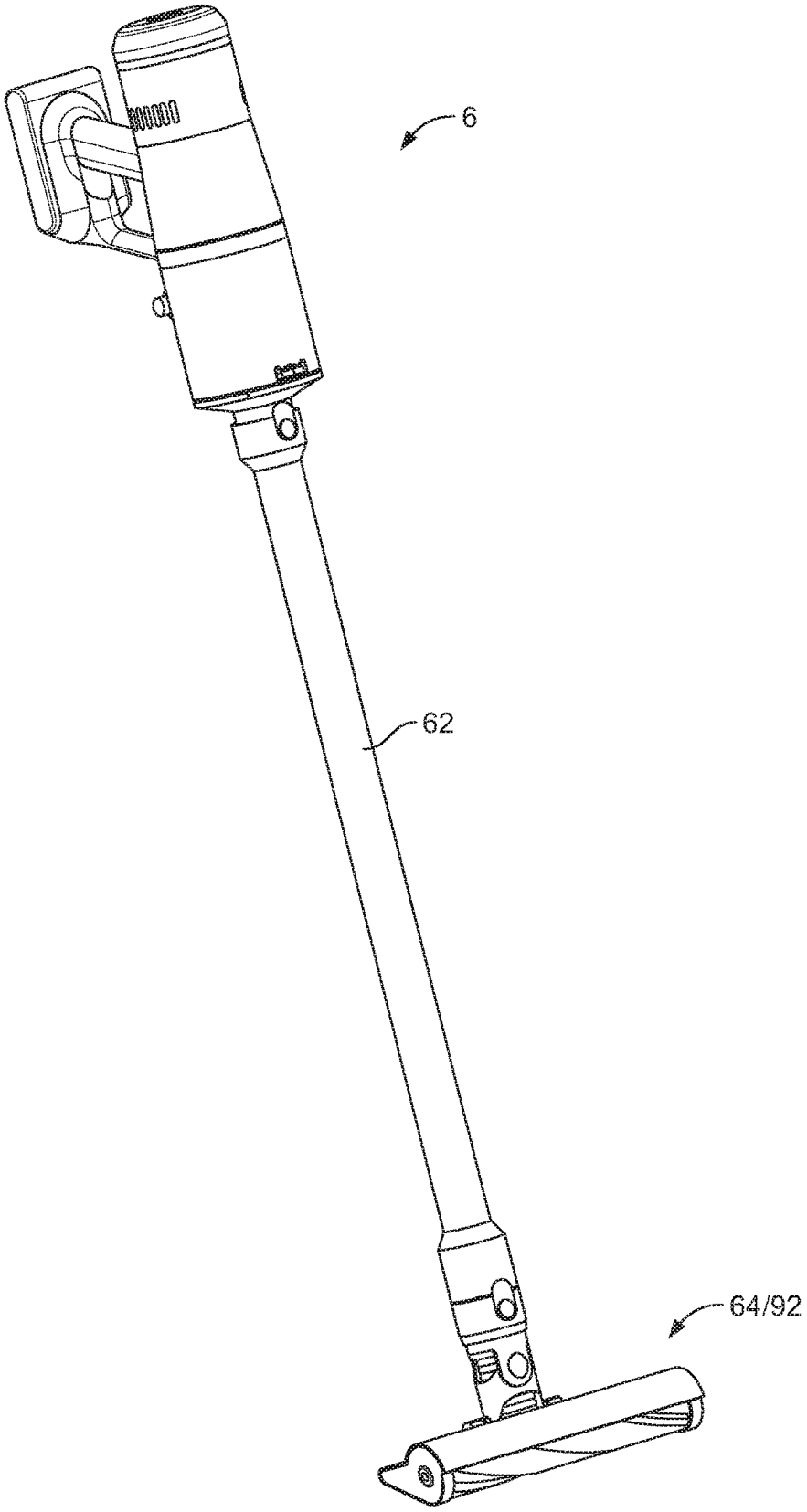
FIG. 4 shows the handheld vacuum cleaner in a stick vac configuration.
Figure 5:
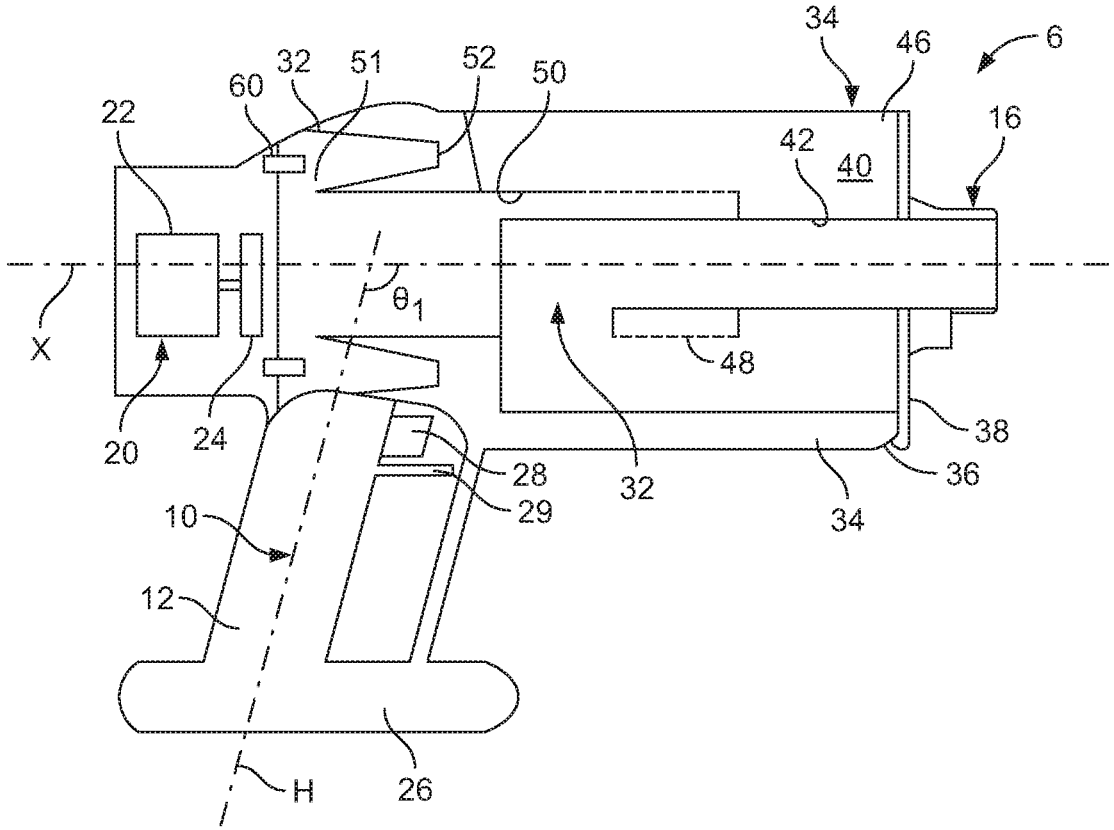
FIG. 5 is a schematic view of the handheld vacuum cleaner on its own, depicting some of its significant internal components.

With reference also to FIGS. 4 and 5, it will be noted that the handheld vacuum cleaner has a form factor of a machine currently marketed by the applicant as the Dyson V10 or V11. Although the overall form factor of the handheld vacuum cleaner 6 is therefore known in the art, a brief overview will now follow for an improved understanding.

The handheld vacuum cleaner 4 comprises a main body 10 having an elongate handle 12, a cyclonic separating unit 14 and a suction inlet 16. As shown the suction inlet 16 is formed as a short nozzle but a cleaning tool or wand extension piece could be releasably attached to the suction inlet 16 as required. The cyclonic separating unit 14 has a longitudinal axis X and extends away from the handle 12 such that the suction inlet 16 is at the end of the cyclonic separating unit 14 which is furthest from the handle 12.

The main body 10 comprises a suction generator 20 including a motor 22 and an impeller 24 which are located above and towards the rear of the handle 12. A battery 26 is located beneath the handle 12. As shown, the battery 26 is located at the end of the handle 12. The handle 12 takes the form of a pistol grip, and a trigger 28 is provided an upper end of the handle 12 for convenient operation. Optionally, and as seen here, a trigger guard 29 extends forwardly from the handle and around the front of the trigger 28. As can be seen, for ergonomic reasons, the handle 12 is generally transverse to the longitudinal axis X of the main body and extends along a handle axis H so as to form an angle $\theta_1$ therewith, which is this example is approximately 110 degrees.

The cyclonic separating unit 14 comprises a primary cyclonic separator 30 and a plurality of secondary cyclonic separators 32, which are positioned downstream from the primary cyclonic separator 30 and are arranged in a circular array about the axis X. Such a configuration is conventional in cyclonic vacuum cleaning technology. The primary cyclonic separator 30 comprises a separator body 34 in the form of a bin having a cylindrical outer wall 36 and an end wall 38, which define at least in part a cyclonic separator chamber 40. The separator chamber 40 is annular in form and extends about the longitudinal axis X. The axis of the separator chamber 40 therefore is coincident with the longitudinal axis X of the machine.

In terms of the flow path through the machine, the suction inlet 16 merges into a central duct 42 that runs centrally through the separator chamber 40, from the end wall 38, along the longitudinal axis X of the machine.

The central duct 42 terminates at a primary cyclone inlet 44 which discharges into the separator chamber 40 near to the top end of the primary cyclonic separator 30. Although not shown clearly in FIG. 5, the primary cyclone inlet 44 is angled at a tangent to the motion of air in the separator chamber 40 in use, as is conventional.

The bottom end of the separator chamber 40 near to the end wall 38 and adjacent part of the cylindrical outer wall 36 together define a dirt collector or bin 46, which serves to collect the relatively large particles that are spun out of the circumferential airflow in the separator chamber 40. The end wall 38 is pivotable with respect to the cylindrical outer wall 36 so that it can be opened to discharge collected dirt from the bin 46. It should be noted at this point that the details of the bin opening mechanism and other related details may be conventional and so further discussion on these points will be omitted. This discussion will therefore focus on the main aspects of the handheld vacuum cleaner 6.

As has been mentioned, the cyclonic separating unit 14 includes a set of secondary cyclonic separators or 'cyclones' 32 which have a geometry optimised for separating fine particles from the flow of air through the machine compared to the relative large particles for which the primary cyclonic separator 30 is optimised. Airflow transitions from the separator chamber 40 of the primary cyclonic separator 30 to the secondary cyclones 32 through a cylindrical permeable shroud 48 that extends about the exterior of the central duct 42. The shroud 48 therefore extends about the longitudinal axis X and is coaxial therewith. The shroud 48 is permeable to air, in the form of a perforated panel such as a mesh, for example, and therefore forms an air outlet from the separator chamber 40 which serves to catch fibrous material on the shroud 48.

The shroud 48 encircles a duct 50 which extends longitudinally along the machine and which defines inlets 51 to the plurality of relatively small secondary cyclones 32. In the usual way, the secondary cyclones 32 are generally conical in form and define a dirt outlet at their respective tips 52 which discharge into a fine dust collector 54. In this example, the fine duct collector 54 is defined by the outer cylindrical wall of the cyclonic separating unit 14 in a radial outward position with respect to the main dirt collector 46. In this configuration therefore, when the end wall 38 is opened, the main dirt collector 46 and the fine dust collector 54 are opened so that direct can be emptied from the machine.

In overview, during use the handheld vacuum cleaner 6 is activated by a user pressing the trigger 28 which powers up the suction generator 20. The suction generator 20 therefore establishes a negative pressure differential through the machine which draws air flow through the suction inlet 16, up the central duct 42 and into the separator chamber 40 where it rotates around the longitudinal axis X. The rotational flow in the separator chamber 40 produces a cyclonic action that separates relatively heavy or large dirty particles from the air. Due to the orientation that the handheld vacuum cleaner 6 is typically used, these large dirt particles will tend to collect in the main dirt collector 46. The partially cleaned air then passed through the shroud 48, along the duct and into the secondary cyclones 32 which act to separate smaller and lighter particles of air, which are expelled through the cyclone tips 52. Clean air is drawn out of respective outlets 60 of the secondary cyclones 32 and through the suction generator 20, where it is discharged to atmosphere.

Notably, FIG. 5 shows the handheld vacuum cleaner in a 'bare' state, in which it does not have a cleaning tool attached to it. However, it should be appreciated that various cleaning attachments may be coupled to the handheld vacuum cleaner as required. In this respect, FIG. 4 shows the handheld vacuum cleaner 6 with a wand 62 attached, which turns the handheld vacuum cleaner 6 into a stick vacuum cleaner or 'stick-vac'. Here, the distal end of the wand 62 in turn has a motorised cleaner head 64 attached to it, including a rotatable agitator, which is optimised for cleaning hard floors or other floor coverings such as carpets and rugs.

Having described the overall configuration of the handheld vacuum cleaner 6, the discussion will focus on the configuration of the robotic drive module 4. This can be seen combined with the handheld vacuum cleaner 6 in many of the drawings, but it can also be seen on its own in FIGS. 6*b* and 7.

The robotic drive module 4 comprises a main body 70 that is flanked by a pair of wheels 72, one on either side of the main body 70. The wheels 72 are circular in this example and comprise a discoidal hub 74, the perimeter of which defines or carries a traction surface 76. The traction surface 76 may be made of a different material than the hub 74 to improve traction on certain surfaces. For example, the traction surface 76 could be a band-like element made of a grippy rubberised material or similar to provide improve traction on hard floors. Although the robotic drive module 4 is provided with circular wheels in this example, it is also envisaged that another type of rolling arrangement could be provided, for example in the form of a tracked drive system. The wheels therefore should be considered to be one type of traction arrangement for the robotic drive module 4.

The wheels 72 are positioned on either side of the main body 70 and have equal diameters. As such, their outer perimeters circumscribe an imaginary cylindrical shape which defines a rolling axis 73, and within which the structure of the main body 70 is contained. More specifically, in the illustrated example, the main body 70 is barrel-like in shape with an outer diameter which is slightly smaller than the outer diameter of the wheels 62. Expressed another way, the main body 70 is generally cylindrical in form and has a diameter approximately the same as the diameter of the wheels 72, in this example.

The main body 70 can be considered to have a forward-facing side 78 and a rearward-facing side 80. The forward-facing side 78 supports a near- or proximal-end of a robotic arm 82. The rearward-face side 80 defines a docking interface, region or portion 84, and this will be described in more detail later. As can be seen, therefore, the general barrel-like shape of the main body 60 is interrupted by suitable recesses 86 for the robotic arm 70 and the docking portion 84.

Figure 9B:
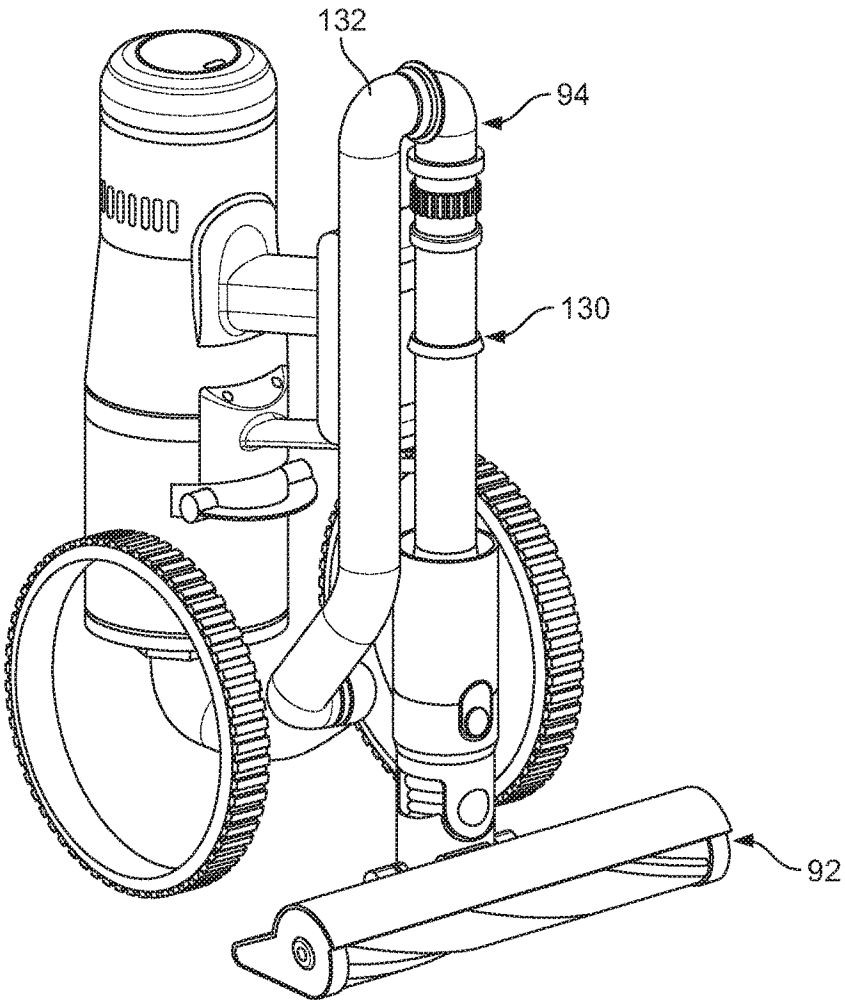
FIG. 9*b* shows a comparable view but which emphasises an airflow path through the machine.
Figure 9A:
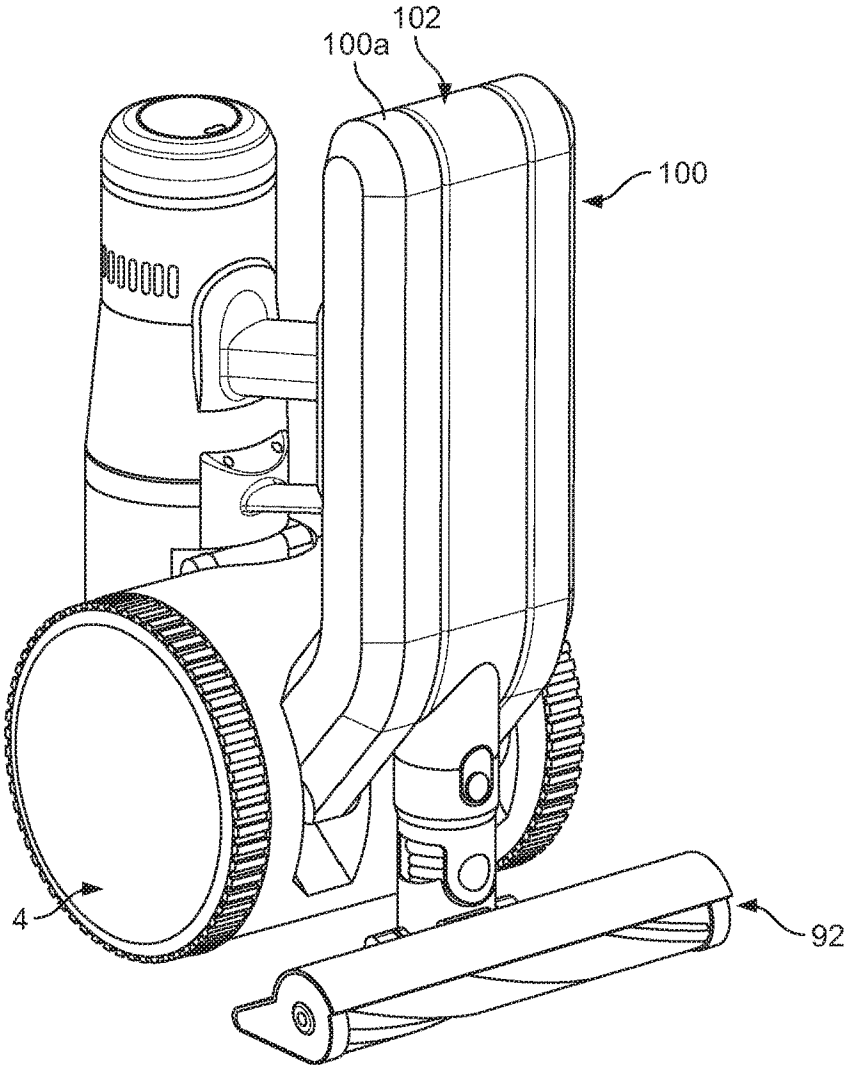
FIG. 9*a* shows a perspective view of the vacuum cleaning system from the front.

The robotic arm 82 is movable with respect to the main body 70 and includes an end effector 90 on its distal end to which different types of cleaning tools can be attached. As shown in the Figures, the end of the robotic arm 82 has a motorised cleaner head 92 attached to it. The robotic arm 82 therefore provides a suction flow path for the robotic vacuum cleaner 2 which extends from the end of the robotic arm 82, along the robotic arm 82 to the main body 70 of the robotic drive module 4 and to the handheld vacuum cleaner 6. FIGS. 9*a* and 9*b* illustrate this neatly as side-by-side views with some of the components of the machine removed so that a suction path 94 through the machine can be appreciated.

In the illustrated embodiment, the robotic arm 82 is articulated and can move between two main configuration: a stowed configuration in which the arm is folded up against the robotic drive module 4, and a deployed configuration in which in an extreme position the robotic arm extends generally straight away from the robotic drive module 4 parallel to the floor surface 101. The fully deployed configuration is shown clearly in FIGS. 2 and 3, and in FIG. 3 it will be noted that a major part of the robotic arm 82 extends parallel to the floor surface 101. In this way therefore, the robotic arm 82 takes up minimal space when in the stowed configuration since it is folded compactly against the robotic drive module 4, but it conveniently can extend in front of the robotic drive module 4 by a significant distance so it can stretch under pieces of furniture and into narrow gaps.

As shown, the robotic arm 82 comprises an upper arm portion 100 and a lower arm or 'forearm' portion 102. The upper arm portion 100 has a first end 104 that is coupled to the main body 70 and a second end 106 that is coupled to the forearm portion 102. Similarly, the forearm portion 102 includes a first end 108 that is coupled to the upper arm portion 100 and a second end 110 that defines the end effector 90.

Although the robotic arm 82 may be configured in various ways, it will be noted that in the illustrated embodiment, the upper arm portion 100 has a two-part structure such that it comprises parallel arm members 100*a*, 100*b*. This provides the robotic arm 82 with a study construction and a suitable torsional rigidity that is more resistant to flexing and twisting.

The connection between the upper arm portion 100 and the main body 70 is achieved by a pair of sockets 112 defined in the main body 60 which receive respective proximal ends of the pair of upper arm members 100*a*, 100*b* to define a shoulder joint 114. Although not shown in FIGS. 1-3 the main body 70 may include a suitable drive system to pivot the upper arm portion 100 with respect to the main body 70 at the shoulder joint 114. Similarly, the distal ends of the upper arm members 100*a*, 100*b* define a yoked elbow joint 116 into which is received an end of the forearm portion 102. The elbow joint 116 is suitably configured to allow the forearm portion 102 to pivot relative to the upper arm portion 100. Separate drive motors (not shown) may be used for this purpose, or the joint 116 may be driven by a drive mechanism powered by the main body 60.

Notably, the shoulder joint 114 and the elbow joint 116 define respective pivot axes, 114', 116'. As shown, the pivot axes 114', 116' are arranged parallel to the ground plane. As such, the pivot axes 114', 116' are also parallel to the rolling axis 73, and perpendicular to the longitudinal axis X of the handheld vacuum cleaner 6. By virtue of the parallel horizontal arrangement of the pivot axes 114', 116' the articulated arm 82 is arranged to pivot about both the shoulder joint 114 and the elbow joint 116 through a substantially vertical plane P.

The upper arm portion 100 has a dog-leg shape when viewed from the side, in this illustrated example, and so each of the upper arm members 100*a*, 100*b* comprises a first section 120 that defines a shallow angle with respect to a second section 122. This is best seen in FIG. 3, which shows clearly that a significant part of the upper arm portion 100, that is, the entirety of the second section 122 thereof, is positioned adjacent a floor surface 101 when the robotic arm 82 is in the fully deployed position. This is beneficial because it enables a significant part of the robotic arm 82 to lay flat against an adjacent floor surface 101. The first section 120 of the upper arm members 100*a*, 100*b* inclines downwardly from the shoulder joint 114 of the main body 70 and then straightens to extend parallel to the floor.

As has been mentioned, the robotic arm 82 can be folded back from its extended or deployed position, shown in FIGS. 2 and 3, to a stowed state as shown in FIG. 1. It can also be controlled to adopt positioned intermediate the two extreme positions. The two-part parallel structure of the upper arm portion 100 is beneficial in this context because it permits the lower arm section 102 to pivot around the elbow joint 116 and nest or sit between the parallel arm members 100*a*, 100*b* of the upper arm portion 100. This allows a particularly compact stowage arrangement for the robotic arm 82. As can be seen in FIG. 1, for example, in the stowed position the lower arm portion 102 is oriented vertically and is flanked by at least a part of the parallel upper arm members 100*a*, 100*b*, that is to say by the second sections 122 thereof. What is more, the upper extremity of the robotic arm 82 is not the highest point of the robotic vacuum cleaner 2, since despite its vertical orientation, it is lower than the vertical height reached by the upper extremity of the handheld vacuum cleaner 6, which is indicated by the line V. This can be seen clearly in FIG. 1. Expressed in another way, no part of the robotic arm 82 extends above the upper extremity of the robotic vacuum cleaner 2.

The two-part structure of the upper arm portion 100 also provides flexibility in terms of how the airflow path is routed from the cleaner head to the main body 70. For example, one of the upper arm members 100*a*, 100*b* can be configured to define the airflow path, whilst the other of the upper arm members 100*a*, 100*b* can be configured to carry the required mechanical and electrical components to power the elbow joint 116. FIGS. 9*a* and 9*b* illustrate this clearly in which a first pipe section 130 extends inside the forearm portion 102 vertically upwards from the cleaner head 92 and which bends through a 180 degree angle to form a second pipe section 132 which extends downwardly through one of the arm sections 100*a* of the upper arm portion 100 and into the main body 70 of the robotic drive module 4.

Having described the robotic arm aspects of the vacuum cleaning system 2, the discussion will now turn to general configuration aspects and docking aspects of the vacuum cleaning system 2.

As has been mentioned above, the main body 70 defines the docking portion 84 which is adapted to accept the handheld vacuum cleaner 6 in such a way as to complete the airflow path through the machine and therefore to provide a source of suction. The handheld vacuum cleaner 6 is arranged in an upright orientation with respect to the floor surface (see FIG. 3) when it is docked with the robotic drive module 4. In this way, the longitudinal axis X of the handheld vacuum clearer 6 is substantially vertical in the illustrated example. Expressed another way, the longitudinal axis X of the handheld vacuum cleaner 6 is generally perpendicular to the floor surface 101, which defines a ground plane. This arrangement provides an ergonomic angle for a user to dock the handheld vacuum cleaner 6 to the robotic drive module 4. This is because a user would tend to hold the handheld vacuum cleaner 2 in such a way to approach the docking portion 84 from above so a vertical docking arrangement is convenient for the user.

As well as being oriented generally vertically, the handheld vacuum cleaner 6 is arranged in the docking portion 84 so that its handle 12 points in the forward direction. That is to say, the linear section of the handle 12 is aligned with a fore-aft axis F of the main body 60. As can be seen in FIGS. 1-3, the arrangement of the handheld vacuum cleaner 6 in the docking interface 84 and its orientation is such that the handle 12 extends over the top of the main body 70 of the robotic drive module 4. With respect to the floor surface/ground plane 101, the handle 12 is generally horizontal, although it should be appreciated that in the illustrated embodiment the handle 12 is not precisely horizontal but defines a small angle therewith.

As will be apparent particularly from the side views of the vacuum cleaning system 2, the handle 12 extends over the robotic drive module 4, in the fore-aft direction F, to an extent that it passes over and extends beyond the rolling axis 73 that is defined by the wheels 72. Notably, the battery 26 is located at the end of the handle 12 and, in the arrangement shown, when the handheld vacuum cleaner 6 is docked on the robotic drive module 4, the battery 26 can be considered to be in a cantilevered arrangement. As such, the battery 26 is supported on the end of the handle 12, which extends in a horizontal direction when the handheld vacuum cleaner 6 is docked on the robotic drive module 4.

Notably, the handle 12 and battery 26 have a combined length so that the end of the battery 26 is at a horizontal position which is approximately in line with the end of the wheels 72. So, the battery 26 can be considered to extend over the top of at least a part of the robotic drive module 4. Furthermore, it should be noted that the direction in which the handle 12 extends is aligned with the direction of the robotic arm 82, so as to be in parallel therewith. The handle 12 can therefore be considered to point in the forward direction of the vacuum cleaning system 2. One benefit of this arrangement is that the weight of the battery 26 provides a balancing effect, as the battery 26 is positioned on the other side of the rolling axis 73 to the main body 10 of the handheld vacuum cleaner 6. Together with the mass of the articulated arm 82, this arrangement provides a convenient means to provide balance to the twin-wheeled arrangement of the robotic drive module 4.

It is particularly apparent from FIG. 1, for example, that the robotic arm 82 in the stowed position is in a folded upright configuration in which a surface of the robotic arm 80 abuts the distal surface of the battery 26. In effect, therefore, the battery 26 provides a movement backstop for the motion of the robotic arm 82 as it travels into its stowed position.

A further benefit associated with the vacuum cleaning system 2 is due to the exchangeability of the cleaner head 92 between the robotic arm 82 and the handheld vacuum cleaner 4. This provides consistency of cleaning when either machine is used to clean the floor and also provides a more efficient package. To permit the sharing of cleaning head, both the suction inlet 16 of the handheld vacuum cleaner 6 and the end effector 90 of the robotic arm 82 are provided with a connector or tool mount of the same format. Therefore, the same cleaner head 92 can be releasably clicked into place on either machine. As well as motorised cleaner heads, it will be appreciated that the handheld vacuum cleaner 6 may be equipped with other cleaning tools, such as crevice tools or mattress tools as desired by the user. Such cleaning tools may be motorised or non-motorised.

Figure 6A:
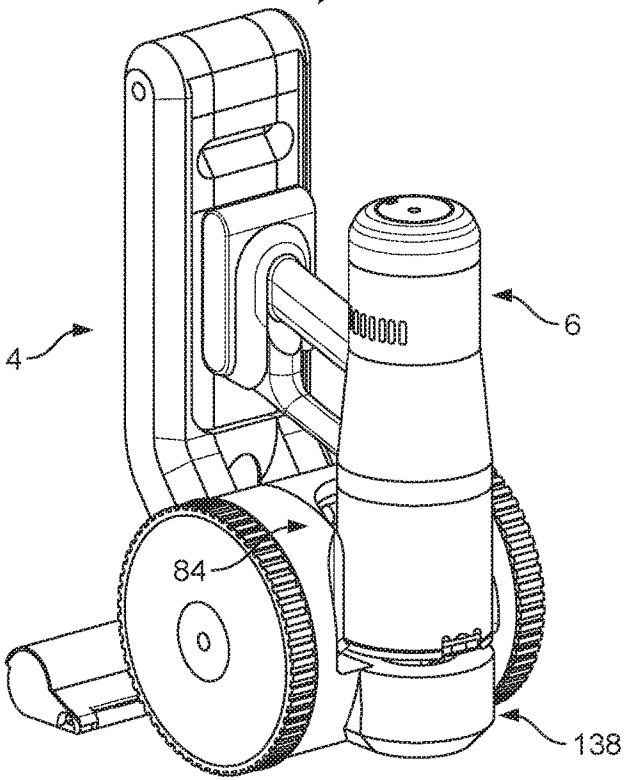
Figure 7:
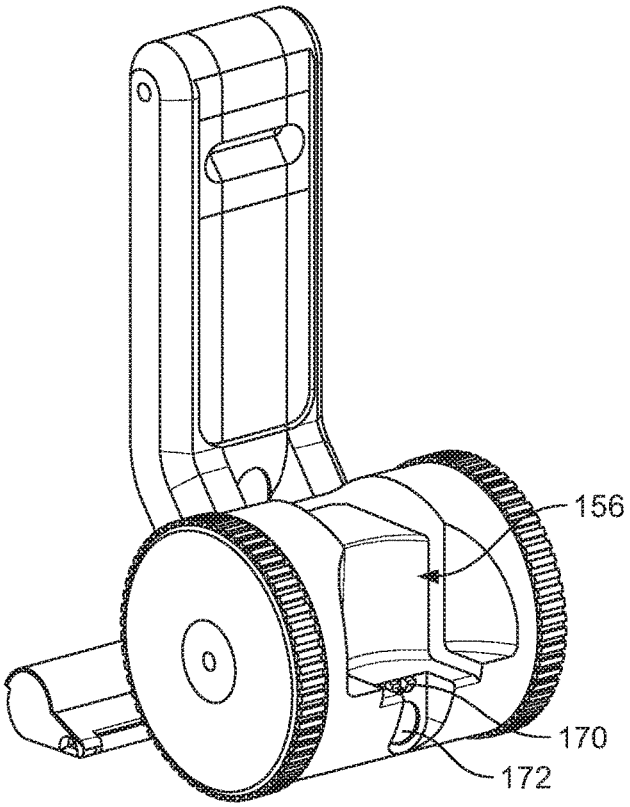
FIG. 7 is a perspective view of the robotic drive module from the rear with a dock insert separated from the docking portion.

Turning now to FIGS. 6*a*, 6*b*, 7 and FIGS. 8*a-c*, the discussion will now focus on the docking aspects of the vacuum cleaning system. Whereas FIG. 6*a* shows the vacuum cleaning system 2 with the handheld vacuum cleaner 6 docked onto the robotic drive module 4, FIGS. 6*a* and 7 show the robotic drive module 4 on its own. Notably, however, FIG. 6*b* depicts a dock insert 138 engaged with the robotic drive module 4 whereas FIG. 7 shows the dock insert 138 removed from the robotic drive module 4.

The docking portion 84 is defined generally by a floor 140 and a curved wall 142 in the rear side 80 of the main body 70 of the robotic drive module 4. The curved wall 142 is shaped to match approximately the circular geometry of the bin of the handheld vacuum cleaner 6. As a result, the handheld vacuum cleaner 6 appears to partially 'sit' in the robotic drive module 4 in a piggy-back configuration. The floor 140 of the docking portion 84 includes the electrical connection and airflow connection which allows the handheld vacuum cleaner 6 to interface effectively with the robotic drive module 4.

As can be seen in FIG. 6*b*, an airflow connector 144 is defined at the centre of the floor 140 of the docking region 84 and this airflow connector 144 is configured to mate with the suction inlet 16 of the handheld vacuum cleaner 6. Likewise, situated next to the airflow connector 144 is an electrical connector 146 which is configured to be mated with a respective electrical connector 148 of the handheld vacuum cleaner 6.

Whereas the airflow connector 144 completes the airflow path through the machine, from the cleaner head 92, along the robotic arm 82 into the main body 70, through the docking portion 84 and finally to the handheld vacuum cleaner 6, the electrical connector 146 may provide power and/or data transfer between the robotic drive module 4 and the handheld vacuum cleaner 6. For example, in terms of electrical power, it is an option for the main body 70 to accommodate a larger battery system than the handheld vacuum cleaner 6 so it may be advantageous to enable the robotic drive unit 4 to power the handheld vacuum cleaner 6. Similarly, when the vacuum cleaning system 2 is docked to an appropriate ground-based docking station for the purposes of charging, the handheld vacuum cleaner 6 may be charged through the robotic drive module 4.

The electrical connection between the robotic drive module 4 and the handheld vacuum cleaner 6 may also be used for data transfer. For example, the user may interact with a user interface 150 provided on the handheld vacuum cleaner 6 in order to command operational functions for the vacuum cleaning system 2. Therefore, the electrical connector 146 provides a means for the commands to be transmitted from the handheld vacuum cleaner 6 to the robotic drive module 4 whereupon they can be acted on by the onboard control system (not shown).

In some examples of the invention, it is envisaged that the docking portion 84 may be an integral part of the main body 70 having a fixed configuration so only a single type of handheld vacuum cleaner 6 is able to dock with it. However, in other examples, it is envisaged that the docking portion 84 may be reconfigurable to enable more than one type of handheld vacuum cleaner to dock with it. One way in which this could be achieved is with movable features on the docking portion 84 which would enable a user to configure the docking portion 84 selectably to interface to a particular handheld vacuum cleaner type. For example, the rear wall 142 may feature sliding sections which could be switched between different positions in order to change the geometry of the docking portion 84 thereby providing support to different types of handheld vacuum cleaners.

Another option is shown in the illustrated examples. Here the docking portion 84 is defined at least in part by the removable dock insert 138. The dock insert 138 is able to be swapped with a different dock insert having a geometry that has been designed to match a different type of handheld vacuum cleaner.

The dock insert 138 comprises base section 152 and a rear wall 154 which are shaped so as to complement a correspondingly shaped recess 156 defined in the main body 70 of the robotic drive module 4.

The base section 152 is generally circular in shape and defines a generally flat annular platform 158 for receiving the leading end of the bin of the handheld vacuum cleaner 6. The annular platform 158 surrounds the airflow connector 144 and electrical connector 146.

The rear wall 154 extends upwardly from the base section 152 and terminates in a transversely extending cap section 160. The rear wall 154 extends about approximately 25% of the perimeter of the base section 152 so as to fit into the recess 156 in the main body 70. In order to conform to the cylindrical outer surface of the bin of the handheld vacuum cleaner, the rear wall 154 is curved in the horizontal plane with a radius of curvature that is comparable to the radius of the base section 152. The rear wall 154 therefore continues the curvature of the rear wall 142 in the main body 70, portions of which flank the rear wall 154 of the dock insert 138.

The cap section 160 has a curved upper surface 162 which extends away from the rear wall 154 in a direction opposite the base section 152. As can be seen by observing FIG. 7, the curved upper surface 162 of the cap section 160 matches the curved upper surface of the generally cylindrical main body 70. Therefore, when the dock insert 138 is fitted to the main body 70, the curved upper surface 162 of the dock insert 138 lays flush with, and therefore blends into, the curved upper surface of the main body 70.

Figure 8A:
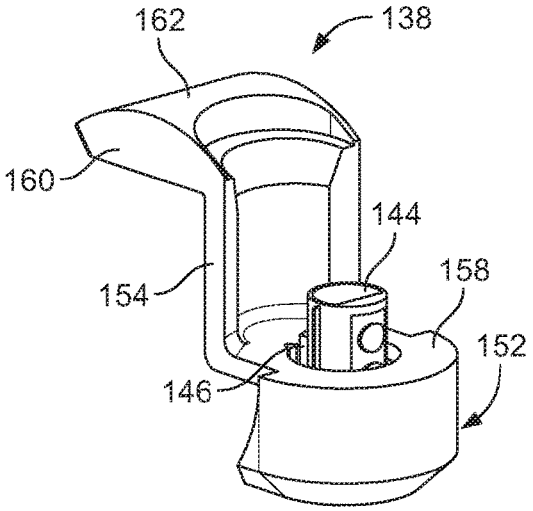
FIG. 8*a-c* show various view of the dock insert.
Figure 8B:
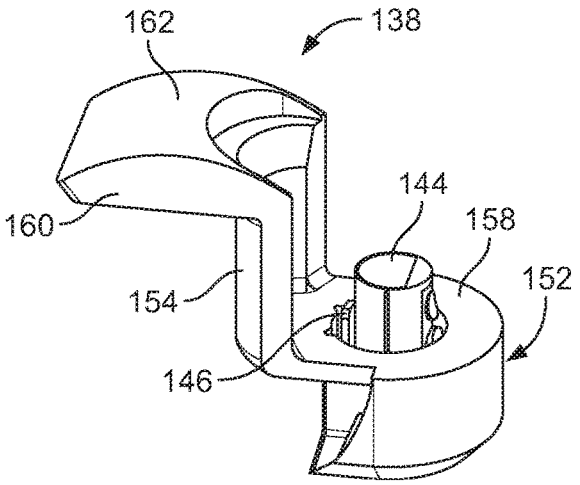
Figure 8C:
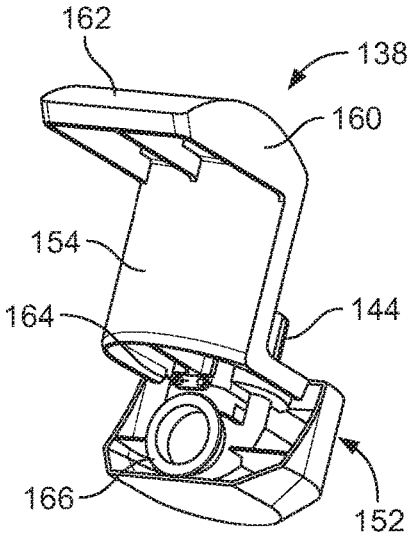

Observing FIG. 8*c*, which shows clearly the underside of the dock insert 138, it will be seen that that a rear edge of the base section 152 is provided with an electrical port 164 and an airflow port 166 which correspond to the electrical connector 146 and the airflow connector 144 respectively. Likewise, FIG. 7 shows the docking portion 84 without the dock insert 138 and it will be appreciated that the docking portion 84 is provided with a respective electrical port 170 and airflow port 172 which are able to mate with the respective ports 164, 166 in the dock insert 138.

Various modifications to the illustrated examples are possible without departing from the scope of the invention as defined by the claims.

The invention claimed is:

1. A vacuum cleaning system comprising:

a robotic unit comprising a traction arrangement that defines a ground plane, and a main body with a recess defined therein, wherein the recess is provided with a first suction port, a first electrical port, and a predefined interface geometry; and a dock insert that is removable from the recess, wherein the dock insert is provided with a second suction port and a second electrical port, wherein the vacuum cleaning system is reconfigurable from a first configuration for engaging with a first handheld vacuum cleaner, and a second configuration for engaging with a second handheld vacuum cleaner which is different to the first handheld vacuum cleaner, wherein when the vacuum cleaning system is in the first configuration, the dock insert is removed such that the first handheld vacuum cleaner is receivable directly within the recess, and when the vacuum cleaning system is in the second configuration, the dock insert is received within the recess such that the first electrical port connects to the second electrical port and such that the first suction port connects to the second suction port.

2. The vacuum cleaning system of claim 1, wherein, in the first configuration, the first suction port, the first electrical port and the predefined interface geometry are configured to directly engage with the first handheld vacuum cleaner.

3. The vacuum cleaning system of claim 1, further comprising the first handheld vacuum cleaner that is configured to releasably engage with the recess without the dock insert attached, such that when the first handheld vacuum cleaner engages with the recess, the first handheld vacuum cleaner is operable to apply suction to the first suction port of the robotic unit.

4. The vacuum cleaning system of claim 3, wherein when the first handheld vacuum cleaner engages with the recess of the robotic unit, the first handheld vacuum cleaner connects to the first electrical port.

5. The vacuum cleaning system of claim 3, further comprising the second handheld vacuum cleaner that is configured to engage with the dock insert.

6. The vacuum cleaning system of claim 5, wherein when the second handheld vacuum cleaner is engaged with the dock insert, the second handheld vacuum cleaner connects to the first suction port and the first electrical port of the robotic unit via the second suction port and the second electrical port of the dock insert.

7. The vacuum cleaning system of claim 5, wherein, when the second handheld vacuum cleaner is docked with the dock insert, the second handheld vacuum cleaner is supported in a position and orientation such that a longitudinal axis of the second handheld vacuum cleaner is oriented generally vertically with respect to the ground plane.

8. The vacuum cleaning system of claim 7, wherein the second handheld vacuum cleaner includes a pistol grip which is oriented generally parallel with respect to the ground plane.

9. The vacuum cleaning system of claim 3, wherein, when the first handheld vacuum cleaner is docked with the recess, the first handheld vacuum cleaner is supported in a position and orientation such that a longitudinal axis of the first handheld vacuum cleaner is oriented generally vertically with respect to the ground plane.

10. The vacuum cleaning system of claim 9, wherein the first handheld vacuum cleaner includes a pistol grip which is oriented generally parallel with respect to the ground plane.

11. The vacuum cleaning system of claim 1, wherein the recess is defined on a first side of the traction arrangement, and wherein an articulated arm extends from the main body of the robotic unit from a point located on a second side of the traction arrangement.

* * * * *